US009385410B2

(12) United States Patent
Kawamura

(10) Patent No.: US 9,385,410 B2
(45) **Date of Patent: *Jul. 5, 2016**

(54) RADIO WAVE HALF MIRROR FOR MILLIMETER WAVE BAND AND METHOD OF FLATTENING TRANSMITTANCE THEREOF

(71) Applicant: ANRITSU CORPORATION, Kanagawa (JP)

(72) Inventor: Takashi Kawamura, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 114 days.

This patent is subject to a terminal disclaimer.

(21) Appl. No.: 14/215,108

(22) Filed: Mar. 17, 2014

(65) Prior Publication Data

US 2014/0292447 A1 Oct. 2, 2014

(30) Foreign Application Priority Data

Mar. 28, 2013 (JP) ..... 2013-068971

(51) Int. Cl.
*H01P 5/02* (2006.01)
*H01P 1/207* (2006.01)
*H01P 7/00* (2006.01)

(52) U.S. Cl.
CPC *H01P 5/02* (2013.01); *H01P 1/207* (2013.01); *H01P 7/00* (2013.01)

(58) Field of Classification Search
CPC ..... H01P 1/207; H01P 1/208; H01P 3/12
USPC ..... 333/208, 209, 252
See application file for complete search history.

(56) References Cited

U.S. PATENT DOCUMENTS 3,101,460 A * 8/1963 Walker ..... H01J 17/04 313/567

OTHER PUBLICATIONS

Tshirogi, Tasuku et, al. "Modern Millimeter—Wave Technologies" In: Wave Summit Course, 1999, p. 68-69, Japan.

* cited by examiner

*Primary Examiner* — Robert Pascal
*Assistant Examiner* — Gerald Stevens
(74) *Attorney, Agent, or Firm* — Pearne & Gordon LLP

(57) ABSTRACT

To provide a radio wave half mirror for a millimeter wave band which can flatten transmittance characteristics and a method of flattening the transmittance of the radio wave half mirror for a millimeter wave band. A radio wave half mirror 20 includes a metal plate 21 that has an outward shape closing a transmission line 11 and a slit 22 for transmitting electromagnetic waves that is provided in the metal plate 21 along a long side of an opening of the transmission line 11. The thickness L of the metal plate 21 in a direction in which the electromagnetic waves pass through the slit 22 is set on the basis of the transmittance characteristics of the electromagnetic waves.

20 Claims, 4 Drawing Sheets

RADIO WAVE HALF MIRROR FOR MILLIMETER WAVE BAND AND METHOD OF FLATTENING TRANSMITTANCE THEREOF

TECHNICAL FIELD

The present invention relates to a technique for flattening transmittance characteristics of electromagnetic waves propagated through a transmission line formed by a waveguide for a millimeter wave band in a radio wave half mirror which is fixed in the waveguide.

BACKGROUND ART

In recent years, there has been a growing need for using radio waves in a ubiquitous network society and thus, a millimeter-wave-band wireless system, such as a wireless personal area network (WPAN) to provide a home wireless broadband service or a millimeter-wave radar for supporting safe and secure driving, has begun to be used. In addition, a 100-GHz ultra wideband wireless system has been actively developed.

In the second-order harmonic evaluation of a wireless system in a frequency band of 60 GHz to 70 GHz or the evaluation of a wireless signal in an ultra-wide frequency band of 100 GHz, as the frequency increases, the noise level of a measurement device and the conversion loss of a mixer increase and thus, the frequency accuracy is reduced. Therefore, a technique for measuring a wireless signal with a frequency higher than 100 GHz with high sensitivity and high accuracy has not been established. In addition, in the measurement technique according to the related art, it is difficult to separate harmonics of a local oscillation signal from the measurement result and to strictly measure, for example, unnecessary radiation.

Various circuit techniques including a narrow-band filter, such as a millimeter-wave-band filter for suppressing an image response and a high-order harmonic response, need to be developed in order to overcome the aforementioned technical problems and to measure a wireless signal in an ultra wideband of 100 GHz with high sensitivity and high accuracy.

For example, as a frequency-variable filter used in the millimeter wave band, the following filters have been known: (a) a filter using a YIG resonator; (b) a filter in which a varactor diode is attached to a resonator; and (c) a Fabry-Perot resonator.

As the filter (a) using the YIG resonator, a filter which can use a frequency up to about 80 GHz has been known. As the filter (b) in which the varactor diode is attached to the resonator, a filter which can use a frequency of up to about 40 GHz has been known. However, it is difficult to manufacture the filter with a frequency higher than 100 GHz.

In contrast, the Fabry-Perot resonator (c) has been used often in the optical field and Non-Patent Document 1 discloses a technique which uses the Fabry-Perot resonator (c) for millimeter waves. Non-Patent Document 1 discloses a confocal Fabry-Perot resonator in which a pair of spherical reflecting mirrors that reflect millimeter waves are arranged so as to be opposite to each other, with a gap equal to a curvature radius therebetween, to obtain a large Q value.

RELATED ART DOCUMENT

Patent Document

[Non-Patent Document 1] Tasuku Teshirogi and Tsukasa Yoneyama, "Modern Millimeter Wave Technologies" Ohmsha, 1993, p 71

DISCLOSURE OF THE INVENTION

Problem that the Invention is to Solve

However, in the confocal Fabry-Perot resonator, when a distance between mirror surfaces is changed in order to tune the passband, defocusing occurs in principle and it is expected that the Q value will be significantly reduced. Therefore, a pair of reflecting mirrors with different curvatures for each frequency needs to be selectively used.

As the Fabry-Perot resonator which is widely used in the optical field, a resonator having the following structure has been used: planar half mirrors are arranged so as to be opposite each other. In this structure, in principle, the Q value does not decrease even when the distance between the mirror surfaces is changed. However, the following problems need to be solved in order to achieve a filter using the plane-type Fabry-Perot resonator in the millimeter wave band.

(A) Plane waves need to be incident in parallel on the half mirrors. When an input to the filter is through the waveguide, it is considered that the plane waves are achieved by increasing the diameter of the waveguide, as in a horn antenna, which results in an increase in size. In this case, it is difficult to achieve perfect plane waves, which results in deterioration of characteristics. (B) The half mirror needs to have a function of transmitting a constant number of plane waves without any change. Therefore, the structure of the half mirrors is limited and flexibility in the design is reduced. (C) Since the resonator is an open type, loss caused by spatial radiation is large.

As a technique for solving the problems, the following structure is considered: a pair of radio wave half mirrors is provided so as be opposite to each other in a transmission line formed by a waveguide that propagates electromagnetic waves in a millimeter wave band in a single mode (TE10 mode); and a resonator is formed between the radio wave half mirrors. According to this structure, a filter is achieved which does not require wavefront conversion and does not have loss caused by spatial radiation.

However, when the radio wave half mirror used in the filter has transmittance characteristics, the frequency characteristics of the radio wave half mirror deteriorate the flatness of the overall transmittance of the radio wave half mirror. When the radio wave half mirror is used in the filter, loss for each frequency or a variation in the passband occurs.

The invention has been made in view of the above-mentioned problems and an object of the invention is to provide a radio wave half mirror for a millimeter wave band which can flatten transmittance characteristics and a method of flattening the transmittance thereof.

Means for Solving the Problem

According to a first aspect of the invention, there is provided a radio wave half mirror (20, 40) for a millimeter wave band that is fixed in a transmission line (11) formed by a waveguide (10) which propagates electromagnetic waves in the millimeter wave band in a single mode, transmits some of incident electromagnetic waves, and reflects some of incident electromagnetic waves. The radio wave half mirror for a millimeter wave band includes: a blocking portion that has an outward shape blocking the transmission line; and a slit (22) for transmitting electromagnetic waves that is provided so as to traverse the blocking portion in a direction in which opposite inner walls of the transmission line are connected. A thickness of the blocking portion in a direction in which the electromagnetic waves pass through the slit is set based on transmittance characteristics of the electromagnetic waves to flatten transmittance characteristics of the radio wave half mirror for a millimeter wave band.

According to this structure, in the radio wave half mirror for a millimeter wave band according to the first aspect of the invention, the thickness of the blocking portion in the direction in which the electromagnetic waves pass through the slit is set based on the transmittance characteristics of the electromagnetic waves. Therefore, when the thickness of the blocking portion is set to a predetermined value, it is possible to flatten the transmittance characteristics.

According to a second aspect of the invention, in the radio wave half mirror for a millimeter wave band according to the above-mentioned aspect, the blocking portion may be a metal plate (21).

According to a third aspect of the invention, in the radio wave half mirror for a millimeter wave band according to the above-mentioned aspect, the blocking portion may include a blocking plate (41) and a metal-plated portion (42) that is formed on a surface of the blocking plate including a slit-side surface. Specifically, the sum of the thickness of the blocking plate in the direction in which the electromagnetic waves pass through the slit and the thickness of the metal-plated portions (42*a*, 42*c*) formed on the surface of the blocking plate is set to a predetermined value based on the transmittance characteristics of the electromagnetic waves. Therefore, it is possible to flatten the transmittance characteristics of the radio wave half mirror for a millimeter wave band.

According to fourth to sixth aspects of the invention, in the radio wave half mirror for a millimeter wave band according to the above-mentioned aspect, a width of a short side of the slit may be set based on the transmittance characteristics of the electromagnetic waves.

According to this structure, in the radio wave half mirror for a millimeter wave band according to the fourth to sixth aspects of the invention, since the width of a short side of the slit is set based on the transmittance characteristics of the electromagnetic waves, it is possible to flatten the transmittance characteristics at a desired transmittance level.

According to a seventh aspect of the invention, there is provided a method of flattening a transmittance of a radio wave half mirror (20) for a millimeter wave band that is fixed in a transmission line (11) formed by a waveguide (10) which propagates electromagnetic waves in the millimeter wave band in a single mode and includes a blocking portion that has an outward shape blocking the transmission line and a slit (22) for transmitting electromagnetic waves that is provided so as to traverse the blocking portion in a direction in which opposite inner walls of the transmission line are connected. The method includes setting a thickness of the blocking portion in a direction in which the electromagnetic waves pass through the slit, based on transmittance characteristics of the electromagnetic waves, to flatten transmittance characteristics of the radio wave half mirror for a millimeter wave band.

According to this structure, in the method of flattening the transmittance of the radio wave half mirror for a millimeter wave band according to the seventh aspect of the invention, the thickness of the blocking portion in the direction in which the electromagnetic waves pass through the slit is set based on transmittance characteristics of the electromagnetic waves. Therefore, it is possible to flatten the transmittance characteristics of the radio wave half mirror for a millimeter wave band.

According to a eighth aspect of the invention, in the method of flattening the transmittance of the radio wave half mirror for a millimeter wave band according to the above-mentioned aspect, the blocking portion may be a metal plate (21).

According to a ninth aspect of the invention, in the method of flattening the transmittance of the radio wave half mirror for a millimeter wave band according to the above-mentioned aspect, the blocking portion may include a blocking plate (41) and a metal-plated portion (42) that is formed on a surface of the blocking plate including a slit-side surface. Specifically, the sum of the thickness of the blocking plate in the direction in which the electromagnetic waves pass through the slit and the thickness of the metal-plated portions (42*a*, 42*c*) formed on the surface of the blocking plate is set to a predetermined value, based on the transmittance characteristics of the electromagnetic waves. Therefore, it is possible to flatten the transmittance characteristics of the radio wave half mirror for a millimeter wave band.

According to tenth to twelfth aspects of the invention, in the method of flattening the transmittance of the radio wave half mirror for a millimeter wave band according to the above-mentioned aspect, a width of a short side of the slit may be set on the basis of the transmittance characteristics of the electromagnetic waves.

According to this structure, in the method of flattening a transmittance of a radio wave half mirror for a millimeter wave band according to the tenth to twelfth aspects of the invention, since the width of a short side of the slit is set based on the transmittance characteristics of the electromagnetic waves, it is possible to flatten the transmittance characteristics at a desired transmittance level.

Advantage of the Invention

The invention can provide a radio wave half mirror for a millimeter wave band which can flatten transmittance characteristics and a method of flattening the transmittance thereof.

BEST MODE FOR CARRYING OUT THE INVENTION

Hereinafter, embodiments of the invention will be described with reference to the drawings.

First Embodiment

Figure 1:
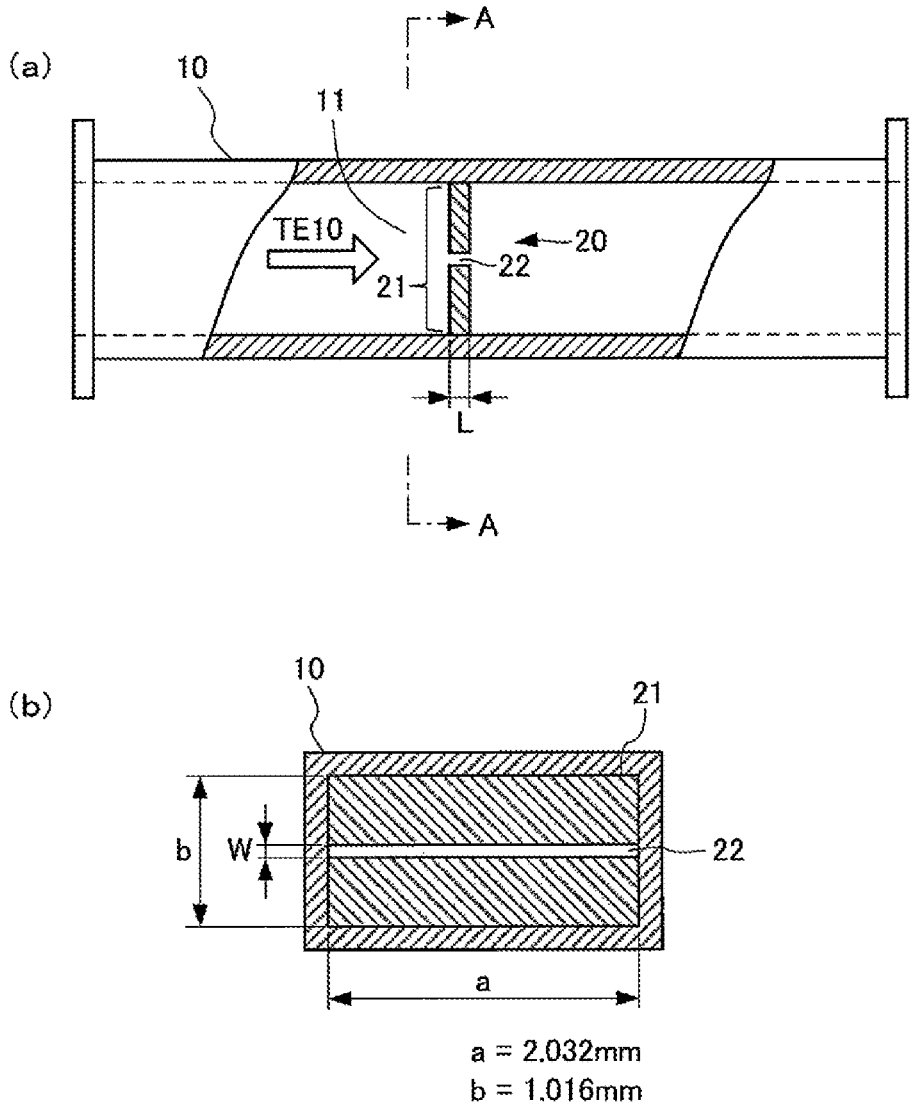
FIG. 1 is a diagram illustrating the structure of a radio wave half mirror for a millimeter wave band according to a first embodiment of the invention.

FIG. 1 shows the structure of a radio wave half mirror 20 for a millimeter wave band (hereinafter, referred to as a "radio wave half mirror") according to this embodiment. FIG. 1(*a*) is a side view and FIG. 1(*b*) is a cross-sectional view taken along the line A-A.

The radio wave half mirror 20 is fixed so as to close a transmission line 11 which is formed in a rectangular waveguide 10 with an inside diameter (a×b=2.032 mm×1.016 mm) capable of propagating electromagnetic waves in a millimeter wave band (for example, an F band) in a single mode (TE10 mode).

The radio wave half mirror 20 has a structure in which a slit 22 for transmitting electromagnetic waves is provided in a rectangular metal plate 21 which is a blocking portion that has a predetermined thickness L (for example, L=0.65 mm) and an outward shape with a size equal to the inside diameter of the waveguide 10 and is inscribed in the waveguide 10. It is preferable that the metal plate 21 be made of a metal material with relatively high conductivity, such as gold, silver, or copper, in order to reduce insertion loss and to increase a Q value. In addition, as shown in FIG. 1(*b*), the slit 22 is formed such that it has a predetermined width W (for example, W=0.05 mm) and traverses the center of the metal plate 21 along a long side of an opening of the waveguide 10. The predetermined width W is also referred to as a width in a direction intersecting the long side of the opening of the waveguide 10.

Next, the simulation result of the characteristics of the radio wave half mirror 20 having the above-mentioned structure will be described. Here, the metal plate 21 is made of gold.

Figure 2:
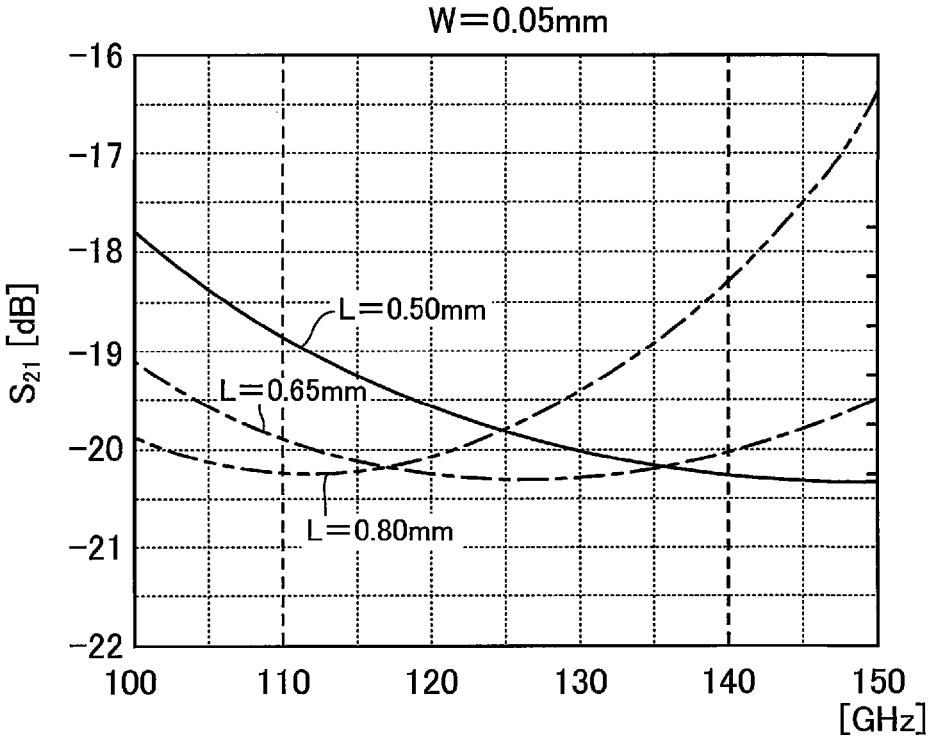
FIG. 2 is a diagram illustrating the relationship between the thickness L and transmittance characteristics of the radio wave half mirror in the first embodiment of the invention.

First, FIG. 2 shows transmittance ($S_{21}$)-frequency characteristics when the width W of the slit 22 is 0.05 mm and the thickness L of the metal plate 21 is changed to 0.5 mm, 0.65 mm, and 0.8 mm. As shown in FIG. 2, the thickness L of the metal plate 21 is changed to change the transmittance characteristics. When the thickness L is 0.65 mm, the transmittance is substantially flat (about ±0.2 dB) in the range of 110 GHz to 140 GHz which is a used band.

Figure 3:
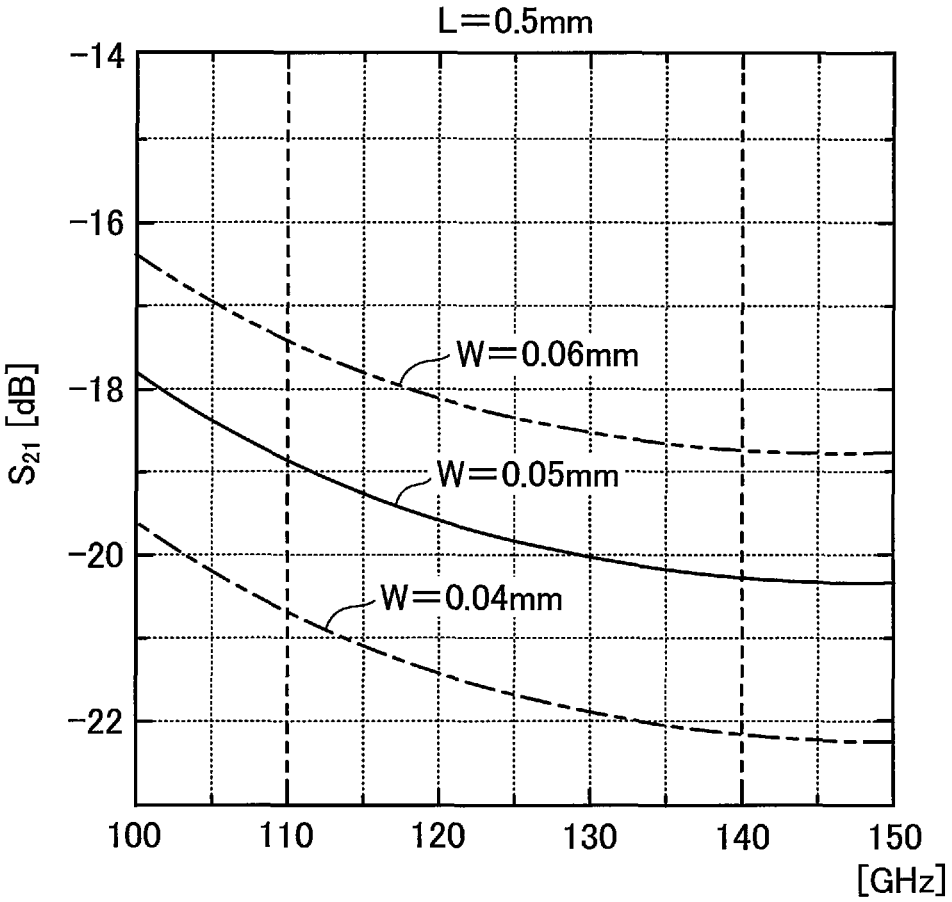
FIG. 3 is a diagram illustrating the relationship between the width of a slit and the transmittance characteristics in the first embodiment of the invention.

FIG. 3 shows transmittance characteristics when the thickness L of the metal plate 21 is 0.5 mm and the width W of the slit 22 is changed to 0.04 mm, 0.05 mm, and 0.06 mm. As can be seen from FIG. 3, when the width W of the slit 22 is reduced, the level of the transmittance is reduced.

In the radio wave half mirror 20 according to this embodiment, the thickness L of the metal plate 21 is set to a predetermined value on the basis of the transmittance characteristics depending on the thickness L of the metal plate 21. In this way, it is possible to obtain the radio wave half mirror 20 with a desired transmittance level. Therefore, when the thickness L (in FIG. 2, L=0.65 mm) of the metal plate 21 is set such that the transmittance characteristics are flat, the radio wave half mirror 20 according to this embodiment can flatten the transmittance characteristics.

The transmittance characteristics depending on the thickness L of the metal plate 21 are combined with the transmittance characteristics depending on the width W of the slit 22 to obtain the radio wave half mirror 20 with desired transmittance characteristics and a desired transmittance level.

The slit 22 may be provided in the metal plate 21 in the radio wave half mirror 20 according to this embodiment. Therefore, it is possible to form the radio wave half mirror 20 with a simple structure. As a result, according to the radio wave half mirror 20 of this embodiment, it is possible to reduce the number of components as compared to a complicated structure. In addition, it is possible to reduce an assembly error in an assembly process and thus improve assembly yield. Therefore, it is possible to reduce manufacturing costs.

Figure 4:
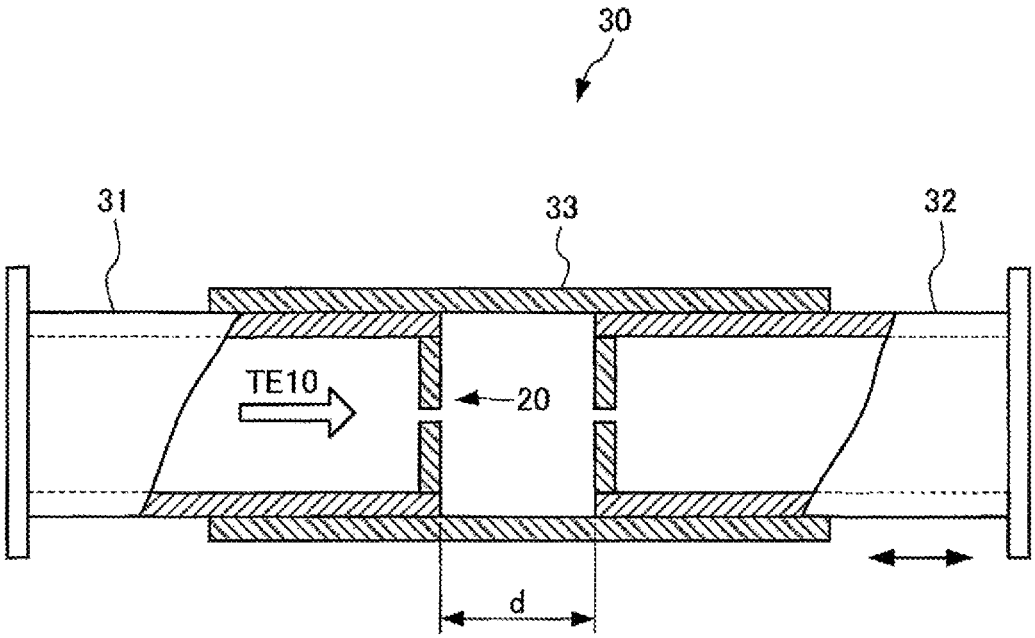
FIG. 4 is a diagram illustrating the structure of a filter for a millimeter wave band according to the first embodiment of the invention.

FIG. 4 shows a filter 30 for a millimeter wave band using the structure of the radio wave half mirror 20.

In the filter 30 for a millimeter wave band, a first waveguide 31 and a second waveguide 32 which are used for the F band and have the same diameter are on the same axis arranged such that the end surfaces thereof are opposite to each other. The ends of the first and second waveguides 31 and 32 are inserted into a third waveguide 33 with a size that is slightly more than those of the first and second waveguides 31 and 32, while being inscribed in both ends of the third waveguide 33. The three successive waveguides, that is, the first waveguide 31, the second waveguide 32, and the third waveguide 33 form a transmission line which propagates millimeter waves in a desired frequency range in the single mode.

Two radio wave half mirrors 20 are attached to the ends of the first waveguide 31 and the second waveguide 32 and at least one of the first waveguide 31 and the second waveguide 32 can slide in the length direction, while being held by the third waveguide 33.

Therefore, a plane-type Fabry-Perot resonator is formed between the two radio wave half mirrors 20 which are opposite to each other. In addition, since a distance d between the two radio wave half mirrors 20 is changed, it is possible to change a resonance frequency. It is possible to achieve a frequency-variable filter for a millimeter wave band which does not require wavefront conversion and has low loss due to external radiation and uniform characteristic over a wide frequency range.

In this embodiment, the frequency-variable filter is given as an example. However, when the frequency is fixed, two radio wave half mirrors 20 may be fixed in one continuous waveguide. In addition, the position of two radio wave half mirrors 20 in the waveguide may be directly changed from the outside.

Second Embodiment

Next, a radio wave half mirror according to a second embodiment of the invention will be described.

Figure 5:
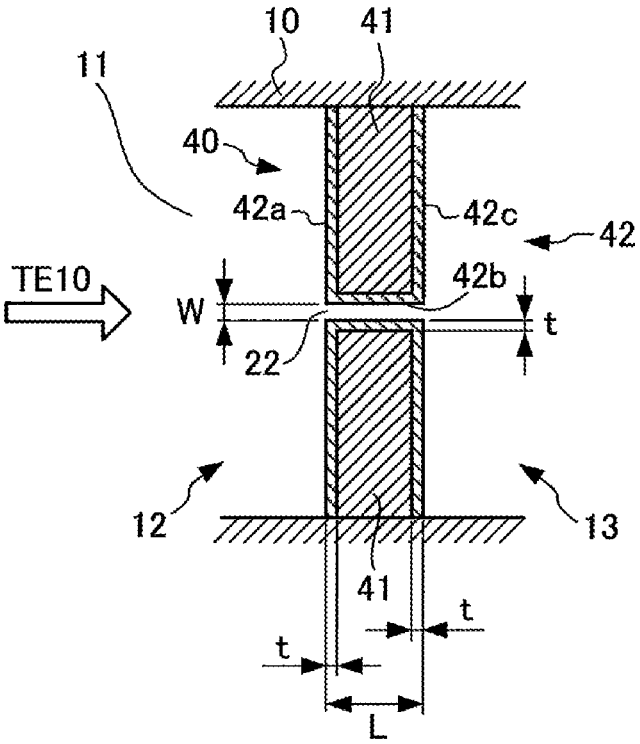
FIG. 5 is a diagram illustrating the structure of a radio wave half mirror for a millimeter wave band according to a second embodiment of the invention.

A radio wave half mirror 40 according to this embodiment is a substitute for the radio wave half mirror 20 according to the first embodiment (see FIG. 1(*a*)) and the structure thereof is shown in FIG. 5.

As shown in FIG. 5, the radio wave half mirror 40 includes a half mirror body 41 which is made of, for example, metal (iron or stainless steel) and a metal-plated portion 42 which is formed on the outer surface of the half mirror body 41. Similarly to the metal plate 21 shown in FIG. 1, the half mirror body 41 is formed in an outward shape with a size equal to the inside diameter of a waveguide 10 so as to be inscribed in the waveguide 10 and forms a blocking plate according to the invention. In addition, a blocking plate having the metal-plated portion 42 formed on the outer surface thereof forms the blocking portion according to the invention. The material forming the half mirror body 41 is not limited to metal, but may be a resin.

The metal-plated portion 42 is formed of a metal-plated material with relatively high conductivity, such as a gold-plated material, a silver-plated material, or a copper-plated material, in order to reduce insertion loss and to increase the Q value. The metal-plated portion 42 includes an incident-side metal-plated portion 42*a* which is formed on the side of an incident-side transmission line 12 to which electromagnetic waves are incident, a slit-side metal-plated portion 42*b* which is formed on the side of a slit 22, and a resonance-portion-side metal-plated portion 42*c* which is formed on the side of a resonance portion 13.

The thickness t of the metal-plated portion 42 may be greater than 0.2 μm which is considered as the skin depth of electromagnetic waves in the range of 110 GHz to 140 GHz, which is a used band, and is, preferably, for example, about 1 μm.

In the above-mentioned structure, when the data according to the first embodiment shown in FIGS. 2 and 3 is applied, the thickness L of the radio wave half mirror 40 and the width W of the slit 22 are set to predetermined values to obtain the radio wave half mirror 40 with desired transmittance characteristics and a desired transmittance level.

As shown in FIG. 5, the thickness L of the radio wave half mirror 40 is the sum of the thickness of the half mirror body 41, the thickness of the incident-side metal-plated portion 42*a*, and the thickness of the resonance-portion-side metal-plated portion 42*c*.

When the half mirror body 41 is made of metal, an incident electromagnetic wave passes through the slit 22 and resonates in the resonance portion 13. The metal-plated portion 42 may include at least the slit-side metal-plated portion 42*b* and the resonance-portion-side metal-plated portion 42*c*. In this case, the thickness L of the radio wave half mirror 40 is the sum of the thickness of the half mirror body 41 and the thickness of the resonance-portion-side metal-plated portion 42*c*.

As such, in the radio wave half mirror 40 according to this embodiment, the thickness L of the radio wave half mirror 40 is set to a predetermined value on the basis of the transmittance characteristics depending on the thickness L of the radio wave half mirror 40. In this way, it is possible to obtain the radio wave half mirror 40 with a desired transmittance level. Therefore, when the thickness L of the radio wave half mirror 40 is set to a value (in FIG. 2, L=0.65 mm) capable of obtaining flat transmittance characteristics, the radio wave half mirror according to this embodiment can flatten the transmittance characteristics.

INDUSTRIAL APPLICABILITY

As described above, the radio wave half mirror for a millimeter wave band and the method of flattening the transmittance of the radio wave half mirror according to the invention have the effect of flattening the transmittance characteristics and are useful as a radio wave half mirror for a millimeter wave band which flattens the transmittance characteristics of electromagnetic waves propagated through a transmission line formed by a waveguide and a method of flattening the transmittance of the radio wave half mirror.

DESCRIPTION OF REFERENCE NUMERALS AND SIGNS

10: WAVEGUIDE
11: TRANSMISSION LINE
12: INCIDENT-SIDE TRANSMISSION LINE
13: RESONANCE PORTION
20, 40: RADIO WAVE HALF MIRROR (RADIO WAVE HALF MIRROR FOR MILLIMETER WAVE BAND)
21: METAL PLATE
22: SLIT
30: FILTER FOR MILLIMETER WAVE BAND
31: FIRST WAVEGUIDE
32: SECOND WAVEGUIDE
33: THIRD WAVEGUIDE
41: HALF MIRROR BODY (BLOCKING PLATE)
42: METAL-PLATED PORTION
42A: INCIDENT-SIDE METAL-PLATED PORTION
42B: SLIT-SIDE METAL-PLATED PORTION
42C: RESONANCE-PORTION-SIDE METAL-PLATED PORTION

What is claimed is:

1. A radio wave half mirror for a millimeter wave band that is fixed in a transmission line (11) formed by a waveguide which propagates incident electromagnetic waves in the millimeter wave band in a single mode, transmits some of the incident electromagnetic waves, and reflects some of the incident electromagnetic waves, consisting of:

a blocking portion that has an outward shape blocking the transmission line; and a slit for transmitting the incident electromagnetic waves that is provided so as to traverse the blocking portion in a direction in which opposite inner walls of the transmission line are connected, wherein a thickness of the blocking portion in a direction in which the incident electromagnetic waves pass through the slit is set based on transmittance characteristics of the incident electromagnetic waves to flatten transmittance characteristics of the radio wave half mirror for the millimeter wave band.

2. The radio wave half mirror for the millimeter wave band according to claim 1, wherein the blocking portion is a metal plate.

3. The radio wave half mirror for the millimeter wave band according to claim 2, wherein a width of a short side of the slit is set based on the transmittance characteristics of the incident electromagnetic waves.

4. The radio wave half mirror for the millimeter wave band according to claim 2, wherein the metal plate is made of at least one of gold, silver and copper.

5. The radio wave half mirror for the millimeter wave band according to claim 4, wherein a thickness of the blocking portion is from 0.5 mm to 0.8 mm.

6. The radio wave half mirror for the millimeter wave band according to claim 5, wherein a width of a short side of the slit is set based on frequency characteristics of a transmittance of the incident electromagnetic waves and is from 0.04 mm to 0.06 mm.

7. The radio wave half mirror for the millimeter wave band according to claim 1, wherein a width of a short side of the slit is set based on the transmittance characteristics of the incident electromagnetic waves.

8. The radio wave half mirror for the millimeter wave band according to claim 1, wherein a thickness of the blocking portion is from 0.5 mm to 0.8 mm.

9. A radio wave half mirror for a millimeter wave band that is fixed in a transmission line (11) formed by a waveguide which propagates incident electromagnetic waves in the millimeter wave band in a single mode, transmits some of the incident electromagnetic waves, and reflects some of the incident electromagnetic waves, consisting of:

a blocking portion that has an outward shape blocking the transmission line; and a slit for transmitting the incident electromagnetic waves that is provided so as to traverse the blocking portion in a direction in which opposite inner walls of the transmission line are connected, wherein a thickness of the blocking portion in a direction in which the incident electromagnetic waves pass through the slit is set based on transmittance characteristics of the incident electromagnetic waves to flatten transmittance characteristics of the radio wave half mirror for the millimeter wave band, and wherein the blocking portion includes a blocking plate and a metal-plated portion that is formed on a surface of the blocking plate including a slit-side surface.

10. The radio wave half mirror for the millimeter wave band according to claim 9, wherein a width of a short side of the slit is set based on the transmittance characteristics of the incident electromagnetic waves.

11. The radio wave half mirror for the millimeter wave band according to claim 9, wherein the metal-plated portion is formed of at least one of gold plating, silver plating and copper plating.

12. The radio wave half mirror for the millimeter wave band according to claim 11, wherein a thickness of the metal-plated portion is equal to or greater than 0.2 μm.

13. The radio wave half mirror for the millimeter wave band according to claim 12, wherein a thickness of the blocking portion is from 0.5 mm to 0.8 mm.

14. The radio wave half mirror for the millimeter wave band according to claim 13, wherein a width of a short side of the slit is set based on frequency characteristics of the transmittance of the incident electromagnetic waves and is from 0.04 mm to 0.06 mm.

15. A method of flattening a transmittance of a radio wave half mirror for a millimeter wave band that is fixed in a transmission line formed by a waveguide which propagates electromagnetic waves in the millimeter wave band in a single mode and consists of a blocking portion that has an outward shape blocking the transmission line and a slit for transmitting the electromagnetic waves that is provided so as to traverse the blocking portion in a direction in which opposite inner walls of the transmission line are connected, the method comprising:

setting a thickness of the blocking portion in a direction in which the electromagnetic waves pass through the slit, based on transmittance characteristics of the electromagnetic waves, to flatten transmittance characteristics of the radio wave half mirror for the millimeter wave band.

16. The method of flattening the transmittance of the radio wave half mirror for the millimeter wave band according to claim 15, wherein the blocking portion is a metal plate.

17. The method of flattening the transmittance of the radio wave half mirror for the millimeter wave band according to claim 16, wherein a width of a short side of the slit is set based on the transmittance characteristics of the electromagnetic waves.

18. The method of flattening the transmittance of the radio wave half mirror for the millimeter wave band according to claim 15, wherein the blocking portion includes a blocking plate and a metal-plated portion that is formed on a surface of the blocking plate including a slit-side surface.

19. The method of flattening the transmittance of the radio wave half mirror for the millimeter wave band according to claim 18, wherein a width of a short side of the slit is set based on the transmittance characteristics of the electromagnetic waves.

20. The method of flattening the transmittance of the radio wave half mirror for the millimeter wave band according to claim 15, wherein a width of a short side of the slit is set based on the transmittance characteristics of the electromagnetic waves.

* * * * *